United States Patent [19]

Terzian

[11] Patent Number: 4,671,673

[45] Date of Patent: Jun. 9, 1987

[54] HOURLY FLAGGED DIGITAL TIME DISPLAYS

[75] Inventor: Berj A. Terzian, Briarcliff Manor, N.Y.

[73] Assignee: Equitime, Inc., Briarcliff Manor, N.Y.

[21] Appl. No.: 880,170

[22] Filed: Jun. 30, 1986

[51] Int. Cl.[4] ..... G04C 19/00; G04C 17/00

[52] U.S. Cl. ..... 368/82; 368/239

[58] Field of Search ..... 368/107-113, 368/82-84, 239-240, 223

[56] References Cited

U.S. PATENT DOCUMENTS 4,264,966 4/1981 Terzian ..... 368/82

4,270,196 5/1981 Terzian ..... 368/82

4,271,497 6/1981 Terzian ..... 368/82

4,483,628 11/1984 Terzian ..... 368/82

*Primary Examiner*—Vit W. Miska

*Attorney, Agent, or Firm*—Lucas & Just

[57] ABSTRACT

Digital time displays are provided for general purpose timekeeping in which each final subminute period before a next hour or, optionally, each initial subminute period after a present hour, is graphically flagged by flashing at least one horizontal segment of pairs of double digit eight arrays flanking an hours display, such arrays being used to display elapsed minutes after a present hour and remaining minutes before a next hour during the time beyond such subminute periods, whereby such flagging occurs in the spaces where minutes are ordinarily displayed and provides singular and unmistakable indicia of such subminute periods to enhance the appeal and efficacy of the displays.

17 Claims, 12 Drawing Figures

HOURLY FLAGGED DIGITAL TIME DISPLAYS

BACKGROUND OF THE INVENTION

1. Field of the Invention

This invention relates to digital time displays that are useful for general purpose timekeeping, i.e., the timekeeping needs and practices of ordinary individuals carrying out their usual day-to-day activities.

2. Description of the Prior Art

Digital time displays of the type referred to above are disclosed, for example, in U.S. Pat. Nos. 4,264,966; 4,271,497; 4,483,628, and copending application Ser. No. 734,979, the disclosures of which are incorporated herein by reference. Typically, these prior disclosures teach the display of hour digits at the center of a display field, minutes after a present hour to the right of present hours, minutes before a next hour to the left of next hours and, optionally, seconds below the hour digits, cycling either between zero and thirty during all minutes or from zero to fifty nine and fifty nine to zero during elapsed and remaining minutes, respectively.

Ser. No. 734,979 specifically discloses the display of oppositely oriented hockey stick-shaped lines below the elapsed and remaining minutes displays, and the omission of zero minute digits during the subminute periods immediately before a next hour and immediately after a present hour. Prototype wrist watches have been manufactured incorporating this system. In these prototypes, during the last fifty nine seconds before a next hour, there is displayed only the next hour digits, seconds below them counting down from fifty nine to zero, a hockey stick line to the left of and pointing downwardly toward the hour digits, and with the space above this line, where remaining minutes are usually displayed, being completely blank. Similarly, during the first fifty nine seconds after a present hour, the prototypes display only the digits defining each such hour, seconds below them counting up from zero to fifty nine, and a hockey stick line to the right of and pointing upwardly away from the hour digits, again with complete blanking of the space above the line where elapsed minutes are subsequently displayed.

Actual experience with these prototypes has demonstrated that the total blanking of the spaces above the hockey stick lines, during the subminute periods immediately before a next hour and immediately after a present hour, may be perceived as undesirable due to being anomalous and/or an insufficient indication of the time during those periods. In particular, the absence of minute digits during such subminute periods requires the viewer to rely almost wholly on the hockey stick lines to understand generally whether the present time is just before the next hour or just after a present hour, a reading which is unique to these periods and not involved at any other time. Moreover, the absence of any time information above the hockey stick lines, where minutes are displayed at all other times, can cause concern or doubt on the part of viewers over the operability or efficacy of the displays during these periods. Elimination of these drawbacks and potential problems would improve the utility and appeal of the previous displays.

SUMMARY OF THE INVENTION

The present invention provides hourly flagged digital time displays which minimize or avoid the problems discussed above. More particularly, in the present displays, one or more of the horizontal segments of pairs of double eight digits flanking the hour digits for display of elapsed and remaining minutes are flashed during the subminute period immediately before a next hour or, optionally, immediately after a present hour, to provide graphic indicators of the diminution or growth of such periods. Since this flashing is observed in the same spaces where minutes are displayed during the rest of the hour, concern or doubt over operability or efficacy that may arise from these spaces being completely blank, as in Ser. No. 734,979, is minimized or avoided.

Moreover, such flashing serves as the principal indicator of the subminute period immediately before a next hour or, optionally, immediately after a present hour, thereby avoiding a potentially anomalous change in reference to the hockey stick lines for the same information. As a matter of fact, in the present displays, the hockey stick lines are preferably eliminated as superfluous during the subminute periods under discussion, thereby enhancing the particularity and unambiguous significance of the flashing observed during these periods.

Preferably a plurality of the horizontal segments of the double eight digits flanking the hour digits is flashed in a predetermined sequence that is indicative, in sequential steps and time intervals, of the diminution of the subminute period immediately before a next hour, or, optionally, the growth of the subminute period immediately after a present hour.

Other features and advantages of the invention will be understood from the subsequent detailed description, taken in connection with the drawings.

DESCRIPTION OF THE PREFERRED EMBODIMENTS

Figure 1:
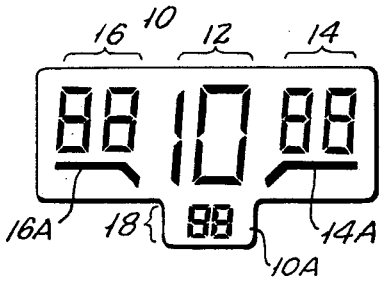
FIG. 1 is a front view of a preferred embodiment of digital display elements arranged for use in accordance with the present invention.

Referring now to FIG. 1, there is illustrated an arrangement of digital display elements similar to those disclosed in U.S. Pat. No. 4,483,628 and Ser. No. 734,979. At the center of a display background 10 are hour elements 12, consisting of a single digit eight array of three horizontal and four vertical bar segments, flanked on the left by two additional vertical bar segments, the segments being selectively energizable to display present and next hour digits ranging from one to twelve. To the right of hour 12 is a first pair of double digit eight arrays 14, each similar to the single array included in the hour elements 12, but of smaller overall size and being selectively energizable to display from zero to thirty elapsed minutes after a present hour.

Below the double eight digits 14 is a hockey stick-shaped line element 14A which may be energized during the first half hour to point upwardly and away from the present hour display 12, relative to the left to right readout direction, thereby underscoring the minutes display 14 and graphically confirming that such values are increasing during the expansion phase of the hour, as previously disclosed in the above-cited patent and application.

To the left of hour elements 12 is a second pair of double digit eight arrays 16, identical in overall size to the pair 14 and selectively energizable to display from twenty nine to zero remaining minutes before a next hour. A hockey stick-shaped line element 6A is also included below this second pair of double eight digits 16, oriented conversely from its twin 14A, to point downwardly and toward a next hour display 12, thereby graphically confirming that the present hour is in its contraction phase when remaining minutes 16 are being displayed.

Below hour elements 12, in a small extension 10A of the display background 10, is a third pair of double eight digits 18 which may be selectively energized to display from zero to fifty nine elapsed seconds during display of elapsed minutes 14 and from fifty nine to zero seconds during display of remaining minutes 16, as previously disclosed in Ser. No. 734,979. This third pair 18 is still smaller in overall size than the first and second pairs 14 and 16. Accordingly, the overall sizes of the digital displays are hours 12 largest, minutes 14 and 16 equal and intermediate, and seconds 18 smallest relative to each other, which visually distinguishes these digits in relation to the magnitudes of the time intervals displayed by each.

Figure 2:
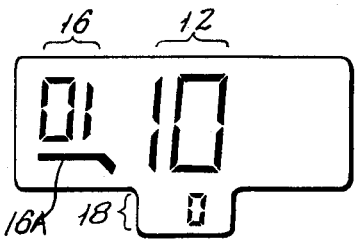
FIG. 2 is a similar view showing the display at exactly one minute remaining before a next hour.

Referring now to FIG. 2, there is illustrated the condition of the FIG. 1 arrangement when displaying the time at exactly one minute and zero seconds before ten, the next hour in this example, with the hockey stick line 16 still energized to confirm that remaining time to that next hour is being displayed. At the next second, which is the commencement of the final subminute period immediately before the next hour, Ser. No. 734,979 teaches that all display of remaining minutes 16 is ended to render this space above the downwardly pointing hockey stick line 16 completely blank, while the remaining fifty nine seconds are counted down by the elements 18. As previously discussed, this may lead to negative viewer perceptions of anomalies, or concern over operability or efficacy of the time presentation.

Figure 3:
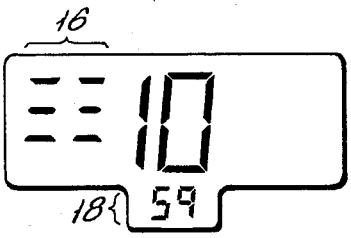
FIGS. 3–9 are similar views showing representative displays during the subminute period immediately before that next hour.

Such problems are minimized or avoided in accordance with the present invention by providing graphic flagging of the fact that the display is showing the final subminute period before the approaching next hour, as is illustrated by comparison of FIG. 2 to FIG. 3. Each of the digit eight arrays 16 includes three horizonal segments which are vertically equally spaced apart, so that the array pair provides two horizontally aligned segments at the top, two in the middle and two at the bottom of the space ordinarily occupied by the remaining minutes display 16. In FIG. 3, at exactly fifty nine remaining seconds, all six of these horizontal segments are energized simultaneously, the hockey stick line 16A is blanked, the fifty nine seconds value is displayed at 18, and the top left one of the horizontal segments is begun to be flashed, by being energized for one half second and then blanked for one half second, while the remaining five segments are maintained continuously energized. Thus, as the countdown of seconds progresses during the initial ten-second interval from fifty nine to fifty seconds, the viewer will see the top left horizontal segment flashing on and off while the other five segments will remain steady on.

Figure 4:
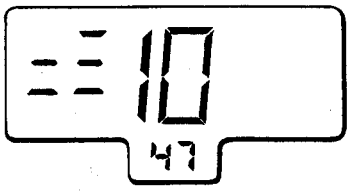

In effect, this flashing is exemplified by comparison of FIG. 3 to FIG. 4, the latter being illustrative of the condition of the display during the next ten-second period of forty nine to forty remaining seconds, when the top right horizontal segment will begin flashing and the previously flashing top left segment will remain blank. By disregarding the forty seven seconds value in FIG. 4 and comparing only the horizontal segments thereof with those shown in FIG. 3, the effect of flashing the top left horizontal segment during the first ten-second interval of the final subminute period will be readily understood. This flashing is maintained as each of the seconds values from fifty nine to fifty is displayed at 18.

Thereafter, commencing at forty nine remaining seconds, the top left horizontal segment is completely blanked and flashing of the top right segment is commenced, as the seconds values from forty nine to forty are displayed at 18. FIG. 4 ilustrates the display during this period at exactly forty seven remaining seconds, with the top right segment on for the first half second of its flash and then to be blanked for the next half second, as is again in effect illustrated by comparison of FIG. 4 to FIG. 5, disregarding the thirty one seconds value in the latter and comparing only the horizontal segments.

Figure 5:
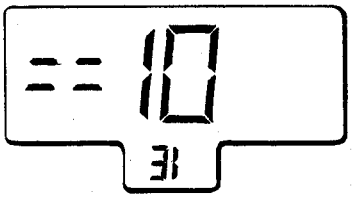

FIG. 5 illustrates the display at thirty one remaining seconds during the third ten-second interval of the subminute period before the hour consisting of thirty nine to thirty seconds. During this interval the middle left horizontal segment of the array pair 16 is flashed and the previously flashed top two segments are completely blanked, as the first half of the final subminute period before the next hour reaches its conclusion.

Figure 6:
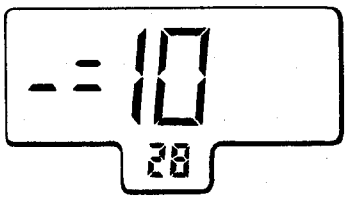
Figure 7:
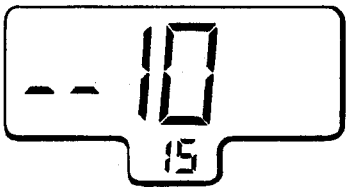

The above described sequence continues during the remaining half of this period, as illustrated in FIG. 6. There the middle right horizontal segment is flashed, while the three that were previously flashed are maintained blank, as the display shows twenty nine to twenty remaining seconds. In FIG. 7, the bottom left horizontal segment is flashed, with blanking of the four that were previously flashed, as the display progresses through nineteen to ten seconds which comprise the fifth and penultimate ten-second interval before the next hour.

Figure 8:
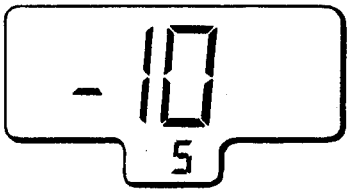
Figure 9:
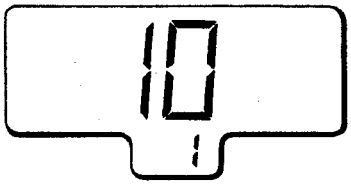

FIGS. 8 and 9 are illustrative of two of the displays seen during the sixth and final ten-second interval before the next hour. In FIG. 8, there are five remaining seconds displayed and the bottom right horizontal segment is flashed on for one half second and off for the next half second, while the previous five flashing segments are completely blank. The off condition of such last flashing segment is shown in FIG. 9, where the final remaining one second before the next hour is on display while the segment is in its last off cycle to complete its final flash. Thus, it will be understood that throughout the final subminute period described above, all remaining seconds values are preferably displayed by the double eight digits 8 for the full interval of each second while the six horizontal segments of the double eight digits 16 are flashed on and off for half second intervals, in the described sequence from top left, to top right, then middle left, middle right, bottom left and finally bottom right.

Figure 10:
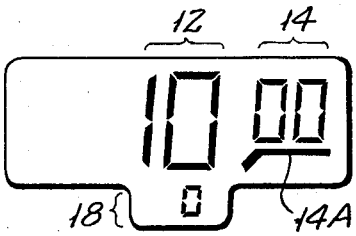
FIG. 10 is a similar view showing the display at exactly the occurrence, of that next hour, which then becomes the present hour.

FIG. 10 illustrates one alternative for completing this sequence and displaying the arrival of the next hour, then the present hour, by showing the tenth hour with elements 12, zero minutes with the double eight digits 14 above the hockey stick line 14A, and zero seconds with the right array of the double eight digits 18. From this point on, the display will count up the first fifty nine seconds comprising the subminute period immediately after the present hour, while the zero minutes 14 and the hockey stick line 14A are also displayed. Accordingly, in this alternative, there is no flagging of such subminute period and, instead, the time values are shown in the manner described above and in the previously cited patents. One advantage of flagging only the subminute period immediately before a next hour is that more emphasis will be given to the viewer of the imminence or approach of that hour rather than its occurrence. This singularity and emphasis may be preferred by some as being of greater importance than the commencement of each new hour.

Figure 11:
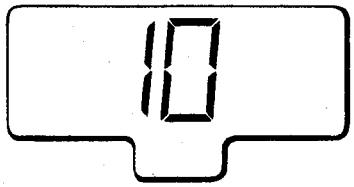
FIG. 11 is a similar view showing an alternative display for the same time as described in FIG. 10.
Figure 12:
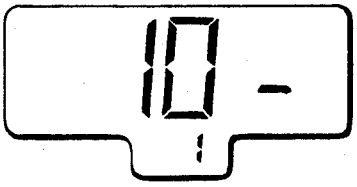
FIG. 12 is a similar view showing a representative display for commencing an optional flashing sequence during the subminute period immediately after the present hour displayed in FIG. 11.

To accommodate other preferences, by flagging both subminute periods flanking each hour, the optional sequence illustrated in FIGS. 11 and 12 can be used as the displays that next follow FIG. 9. As previously explained, FIG. 9 is the appearance of the display during the second half of the final second before the tenth hour, when the last flashing bottom right segment of the digit arrays 16 is off.

At the completion of that half second, the occurrence of the tenth hour is displayed by energizing only the digits 10 of the hour elements 16, as is illustrated in FIG. 11 and described in Ser. No. 734,979. At the next second, as illustrated in FIG. 12, the digit arrays 18 are energized to show the value of one second, and the bottom left one of the horizontal segments of the digit eight pair 14 is commenced to be flashed in the alternating half second on/off cycle previously described in connection with FIGS. 3-9. Such flashing is continued throughout the first subminute period after the tenth hour, in converse manner to the flashing that was described for the previous figures. In particular, the flashing sequence for the first subminute period after the hour is also in ten-second intervals for each horizontal segment of the arrays 14, commencing with the bottom left, then bottom right, middle left, middle right, top left and ending with the top right, with each segment being maintained steady on after its ten-second flashing interval so that the space on the right side of the hour digits 12 is gradualy filled by all six horizontal segments. Again the hockey stick 14A is simultaneously blanked. This is the converse of the flashing and gradual disappearance of the six horizontal segments of the double eight digits 16 previously described in connection with FIGS. 3-9, and symbolizes the growth of the first subminute period after that next hour has become the present hour.

The invention has now been described in terms of two embodiments which enable flagging of one or the other, or both, of the subminute periods immediately before a next hour and immediately after a present hour. With reference to the sequence illustrated in FIGS. 2-10, several important advantages of the invention will be evident. First, energization of all six horizontal segments of the double eight digits 16 commencing at fifty nine remaining seconds before the next hour, and simultaneous blanking of the hockey stick 16A, provides unmistakable visual flagging of the fact that the present time has entered this final subminute period. The subsequent flashing and blanking of these segments in ten-second intervals provides continuing graphic flagging of the diminution of this period, in steps that gradually approach the bottom of the hour digits 12, such being the same direction as the hockey stick line 16A points to during the earlier remaining portion of the present hour. Therefore, the flagging sequence is visually correlated to the lapsing of the final subminute period in a progression that is directionally consistent with the displays seen in the earlier portion of this second half hour, thereby serving as both a compatible and effective indicator of the diminution of this period. The occurrence of such flagging in the space where remaining minutes are otherwise displayed also makes it impossible to experience doubt or concern over the operability or efficacy of the display during this period. Finally, blanking of the hockey stick line 16A during this same period avoids any ambiguous change in context or reference to this indicator, as may occur with the displays described in Ser. No. 734,979.

Similar advantages are achieved if the first subminute period immediately after a present hour is also flagged in the converse manner described in connection with FIGS. 9, 11 and 12. In this case, the horizontal segments of the double eight digits 14 gradually fill the space where elapsed minutes are subsequently displayed, in a progression that starts from the bottom of the hour digits 12 and stepwise moves up and away, in the same direction as the hockey stick line 14A subsequently points away from the hour digits during the first half hour. Therefore, the flagging sequence is a visual indicator of the stepwise growth of the first subminute period after a present hour, until that period ends with a simultaneous display of one elapsed minute above the hockey stick line 14A and zero seconds below the hour.

Other flagging patterns or sequences may be used in accordance with the invention. For example, each of the six horizontal segments may be separately flashed and blanked in the sequence described for FIGS. 3-9 to lead the eye with a single flashing segment from the top most remote position to the bottom most adjacent position to the hours display. Alternatively, the segments can be energized in simultaneous pairs starting with the top pair, then the middle pair and lastly the bottom pair, with the left member of each pair flashed first for ten seconds, followed by the right member for ten seconds and then blanking of both, as flashing of each successive lower pair is carried out in the same manner.

Another alternative is to flash simultaneously the top left, middle right and bottom left horizontal segments of the double eight digits 16 throughout the entire final subminute period before each next hour. This will provide a stylized arrowhead pointing toward the next hour as a graphic flag that the final subminute period is underway. Or only the middle right segment may be flashed by itself throughout the same period to provide a similar simpler flag. The above described alternatives also may be carried out optionally in a converse manner with the horizontal segments of the double eight digits 14 to accomplish similar graphic flagging of the first subminute period after a present hour. The use of at least one flashing horizontal segment of one or the other, or both, of the double eight digit pairs 14 and 16 is a particularly effective flag in accordance with this invention because such segments are never displayed alone during the display of minutes and seconds. Therefore, such flashing segments cannot be confused with the time displays seen beyond the final and initial subminute periods flanking the hour.

It will be understood that the invention may be practiced with any form of energizable digital display elements, e.g., liquid crystals, light emitting diodes, fluorescent or incandescent lamps, gas discharge tubes, and the like, and that the logic diagrams disclosed in the previously cited patents may be modified in known manner to provide the flashing horizontal segments described herein.

It will also be understood that the present invention is not limited to the preferred embodiments, but encompasses the subject matter delineated by the following claims and all equivalents thereof.

The following is claimed:

1. Hourly flagged digital time displays which comprise:

(a) hour elements operable to display present or next hour digits during the same hour;

(b) a first pair of double eight digits positioned to the right of the hour elements and operable to display elapsed minutes after a present hour;

(c) a second pair of double eight digits positioned to the left of the hour elements and operable to display remaining minutes before a next hour; and (d) means for flashing at least one of the horizontal segments of the first or second pair of double eight digits during the subminute period immediately before a next hour or immediately after a present hour, respectively, thereby providing graphic flagging of such subminute periods.

2. Displays in accordance with claim 1 in which a plurality of the horizontal segments of the first or second pair of double eight digits is flashed in a predetermined sequence indicative of the diminution of the subminute period immediately before a next hour or the growth of the subminute period immediately after a present hour, respectively.

3. Displays in accordance with claim 1 which include a third pair of double eight digits operable to display fifty nine to zero remaining seconds during the subminute period immediately before a next hour and zero to fifty nine elapsed seconds during the subminute period immediately after a present hour.

4. Displays in accordance with claim 2 which include a third pair of double eight digits operable to display fifty nine to zero remaining seconds during the subminute period immediately before a next hour and zero to fifty nine elapsed seconds during the subminute period immediately after a present hour.

5. Displays in accordance with claims 1, 2, 3 or 4 in which, commencing at fifty nine remaining seconds before a next hour, all six horizontal segments of the second pair of double eight digits are displayed simultaneously and thereafter successively and individually flashed for ten-second intervals at the end of which each segment is blanked, the flashing sequence of all the segments, from beginning to completion, being top left, top right, middle left, middle right, bottom left, bottom right, thereby providing graphic flagging in ten-second steps and intervals of the diminution and termination of the subminute period immediately before the next hour.

6. Displays in accordance with claims 1, 2, 3 or 4 which include hockey stick-shaped lines below the first and second pairs of double eight digits, such hockey stick lines being displayed with, respectively, elapsed and remaining minutes displayed by such double eight digits at all times except during the subminute period immediately before a next hour or immediately after a present hour.

7. Displays in accordance with claim 6 in which display of the hockey stick-shaped lines is maintained at all times except during the subminute period immediately before a next hour.

8. Displays in accordance with claim 1 in which the overall size of the minute digits is smaller than the overall size of the hour digits.

9. Displays in accordance with claims 3, 8 or 4 in which the overall sizes of the hour, minute seconds digits are, respectively, largest, intermediate and smallest relative to each other.

10. Displays in accordance with claim 8 in which the seconds digits are displayed below the hour digits.

11. Displays in accordance with claim 4 which include hockey stick-shaped lines below the first and second pairs of double eight digits, such hockey stick lines being displayed with, respectively, elapsed and remaining minutes displayed by such double eight digits at all times except during the subminute period immediately before a next hour or immediately after a present hour.

12. Displays in accordance with claim 4 in which the overall sizes of the hour, minute and seconds digits are, respectively, largest, intermediate and smallest relative to each other.

13. Displays in accordance with claim 5 in which the overall sizes of the hour, minute and seconds digits are, respectively, largest, intermediate and smallest relative to each other.

14. Displays in accordance with claim 6 in which the overall sizes of the hour, minute and seconds digits are, respectively, largest, intermediate and smallest relative to each other.

15. Displays in accordance with claim 12 in which the seconds digits are displayed below the hour digits.

16. Displays in accordance with claim 13 in which the seconds digits are displayed below the hour digits.

17. Displays in accordance with claim 14 in which the seconds digits are displayed below the hour digits.

* * * * *

UNITED STATES PATENT AND TRADEMARK OFFICE

CERTIFICATE OF CORRECTION

PATENT NO. : 4,671,673

DATED : June 9, 1987

INVENTOR(S) : Berj A. Terzian

It is certified that error appears in the above-identified patent and that said Letters Patent is hereby corrected as shown below:

Column 2, line 64, after "hour" insert --elements--.

Column 8, line 24, after "minute" insert --and--.

Signed and Sealed this

Seventeenth Day of November, 1987

*Attest:*

DONALD J. QUIGG

*Attesting Officer*

*Commissioner of Patents and Trademarks*